US005082449A

United States Patent [19]

Borgstrom et al.

[11] Patent Number: 5,082,449

[45] Date of Patent: Jan. 21, 1992

[54] REMOVABLE MEDIA INJECTION FITTING

[75] Inventors: Alan D. Borgstrom, Hackettstown, N.J.; Glen J. Bertini, Bay City; Daniel F. Meyer, Midland, both of Mich.

[73] Assignees: Amerace Corporation, Parsippany, N.J.; Dow Corning Corporation, Midland, Mich.

[21] Appl. No.: 573,726

[22] Filed: Jul. 28, 1990

[51] Int. Cl.[5] ..... H01R 4/58

[52] U.S. Cl. ..... 439/88; 439/190; 439/912; 439/921

[58] Field of Search ..... 439/88, 206, 89, 181, 439/183, 184, 185, 190, 191, 198, 201, 205, 921

[56] References Cited

U.S. PATENT DOCUMENTS

| | | | |
|---|---|---|---|
| 3,649,952 | 3/1972 | Harmon | 439/190 |
| 3,883,208 | 5/1975 | Sankey et al. | 439/921 |
| 4,202,591 | 5/1980 | Borgstrom | 439/921 |
| 4,946,393 | 8/1990 | Borgstrom et al. | 439/88 |

*Primary Examiner*—Larry I. Schwartz
*Assistant Examiner*—Kevin J. Carroll
*Attorney, Agent, or Firm*—David Teschner

[57] ABSTRACT

A media injection fitting for the insertion or removal of a media from the interior of a high voltage separable connector component having an access to the interior of the component. The fitting is comprised of a central body portion having a passage from an exterior side surface to the bore of a pin extending beyond the fitting for insertion into the bore of the access. A skirt extends from one end of the body portion so proportioned and configured as to be positionable upon the outer surface of the component access with a locking means on the interior surface of the skirt to fix the fitting upon the access. A pulling eye extends from the second end of the body portion to permit installation and removal of the fitting from the surface of the access. A coupling on the exterior side surface connected to the passage permits the insertion or removal of a media from the component or the venting of gases contained therein.

8 Claims, 4 Drawing Sheets

REMOVABLE MEDIA INJECTION FITTING

BACKGROUND OF THE INVENTION

1. Field of the Invention

The invention relates to a fitting for the introduction of fluids, gases or other media into the conductor strand interstices of a high voltage cable, for venting fluids or gases within said components and the flushing of media through said components and/or an intermediate high voltage cable.

2. Description of the Prior Art

The present invention provides an alternative media injection fitting to that shown and described in U.S. Letters Pat. No. 4,946,393, issued Aug. 7, 1990, by Alan D. Borgstrom and David R. Stevens entitled "Separable Connector Access Port and Fittings" assigned to Amerace Corporation.

SUMMARY OF THE INVENTION

The present invention provides an alternative media injection fitting which does not require threadable engagement between the fitting and the access and which can be rotatably locked upon the exterior surface of such access by employing an annular rib on said fitting which engages the complementary recess on the exterior surface of said access.

The fitting has a central body portion having a first end and a second end and a side wall with an internal passage extending from said side wall to said first end. A coupling on said side wall permits the injection of fluids, gases or other media into said passage at said side wall, and a pin with a central bore at said first end of said body portion permits the injection of such through the bore of a component access into the interior thereof. Alternatively, the application of an appropriate pumping device to the coupling can withdraw fluids or gases or media from the component interior. A skirt proportioned and configured to be positionable upon the outer surface of the component access contains a locking annular ring on the inner surface of the skirt which mates with a corresponding annular recess on the exterior surface of the access. The skirt locks to lock the fitting to the access while permitting a 360° rotation about the longitudinal axis of the fitting to facilitate use of the fitting while preventing separation of the fitting from the access and thus removing the pin from the access bore during insertion or removal operations. A pulling eye on the second end of the body portion permits the fitting to be installed on the access, rotated to the desired location and removed therefrom as with a hot stick. It is an object of this invention to provide a fitting for the injection or removal of a medium through the access of a high voltage separable connector component.

It is another object of the invention to provide a fitting for the injection or removal of a medium through the access of a high voltage separable connector component positionable or removable from said component by use of a hot stick.

It is yet another object of the invention to provide a fitting for the injection or removal of a medium through the access of a high-voltage separable connector which can be selectively locked upon said access.

It is still another object of the invention to provide a fitting for the injection or removal of a medium through the access of a high voltage separable connector which can be selectively locked upon said access and rotated about the longitudinal axis of the fitting to facilitate its use.

Other objects and features of the invention will be pointed out in the following description and claims and illustrated in the accompanying drawings which disclose, by way of example, the principle of the invention and the best mode which has been contemplated for carrying it out.

BRIEF DESCRIPTION OF THE DRAWING

In the drawings in which similar elements are given similar reference characters.

DESCRIPTION OF THE PREFERRED EMBODIMENTS

Figure 1:
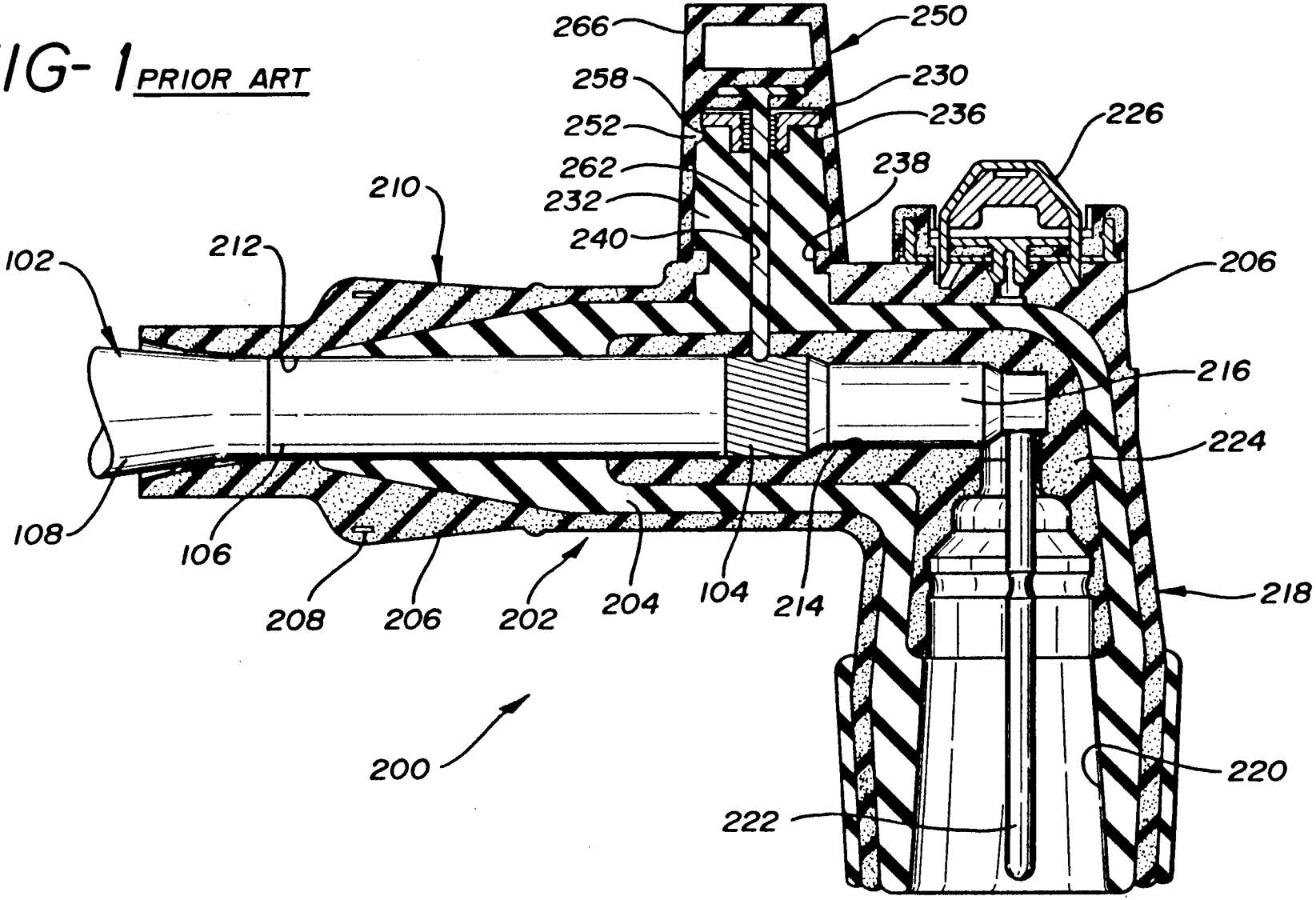
FIG- 1 PRIOR ART
FIG. 1 is a side elevational view, in section, of a high voltage separable connector component—namely an elbow having an access with a sealing cap installed and is FIG. 4 of the above-identified U.S. Pat. No. 4,946,393 issued Aug. 7, 1990.
Figure 2:
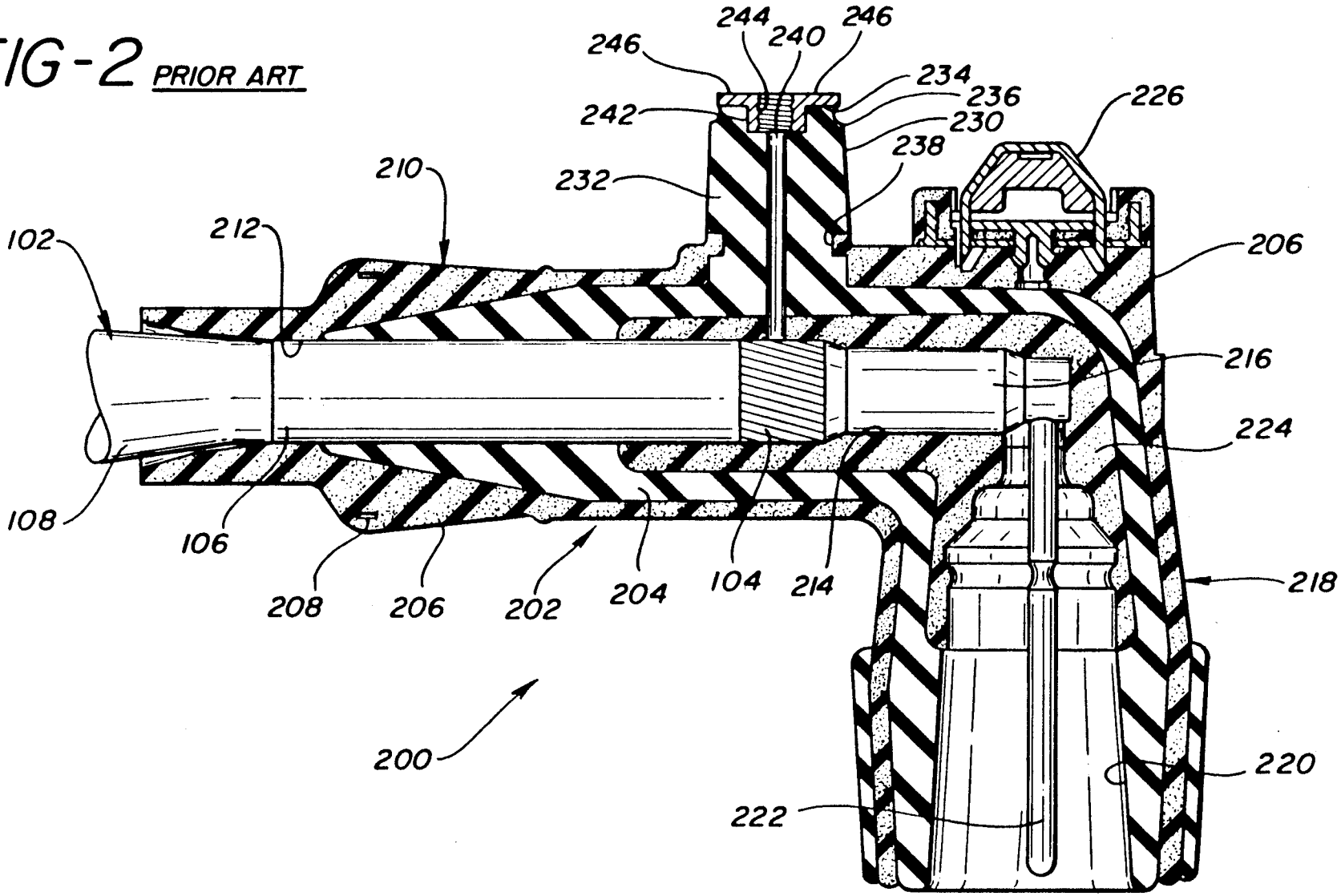
FIG-2 PRIOR ART
FIG. 2 is a side elevational view, in section, of the component of FIG. 1 with the sealing cap removed and is FIG. 2 of U.S. Pat. No. 4,946,393 issued Aug. 7, 1990.

Turning now to FIGS. 1 and 2, there is a high voltage separable connector component or elbow 200. Elbow 200 has a body portion 202 molded of an insulating elastomeric 204. Molded to body portion 202 and with void-free interfaces is an external shield 206 of conductive elastomeric.

The shield 206 is interrupted on leg 210 and the insulating elastomeric 204 of body portion 202 is upwardly extended, away from bores 212 and 214 to form projection 230 having a generally frusto-conical cross-section with its wide diameter base 232 adjacent shield 206 of body portion 202 and its smaller diameter free face 234 remote therefrom. Adjacent free face 234 is an annular recess 236 to receive the detent rib of the cap to be described below. A central bore 240 extends through projection 230 from free face 234, through the conductive elastomeric shield 224 into central bore 212 of leg 210 as is shown in FIG. 2.

The presence of central bore 240 creates a break in the shield layer 206 and a break in the insulation body 204. To fully restore the integrity of the body insulation 204 and complete the shield layer 206, a cap 250 as is seen in FIG. 1 is employed. The cap 250 is more fully described and claimed in the above-identified application and is summarily described herein. Cap 250 has a hollow skirt portion 252 in a frusto-conical shape to closely conform to the outer surface of projection 230. On the interior surface 254 of skirt portion 252, remote from free end 256, is an annular detent rib 258 configured and positioned to engage annular recess 236 and to hold in assembly cap 250 and projection 230. The interior surface 254 of skirt 252 is dimensioned to provide an interference fit with the outer surface of projection 230 to exclude air and seal against moisture.

An insulating rod 262 is so dimensioned that when inserted into bore 240 of projection 230, it dilates the insulating material 232 which defines the bore 240 so that it firmly grips rod 262 in an interference fit. In that manner, the bore 240 is completely filled and the dielectric strength of projection 230 is restored as shown in FIG. 1.

Injecting fluids, gases or other media into the access or venting gases and pumping out fluids, gases or media used to flush the cable, all can be accomplished while the cable and connector components are fully energized. To do this, it is necessary to remove the cap 250 and replace it with a fitting which permits the appropriate fluids, gases or media to be injected into the component via the access or permit the venting of gases (hydrogen) generated by corrosion of the cable conductor. Also, liquid moisture and are expelled contaminants from the cable when driven by a clean, dry replacement media from a similar fitting attached to a separable connector component on the other end of the cable. Certain electro-mechanical destruction of the cable insulation, called "treeing" can be stopped and the quality of the cable insulation restored by the injection of Dow Corning Cable Restoration Fluid No. XZ-2614.

Figure 4:
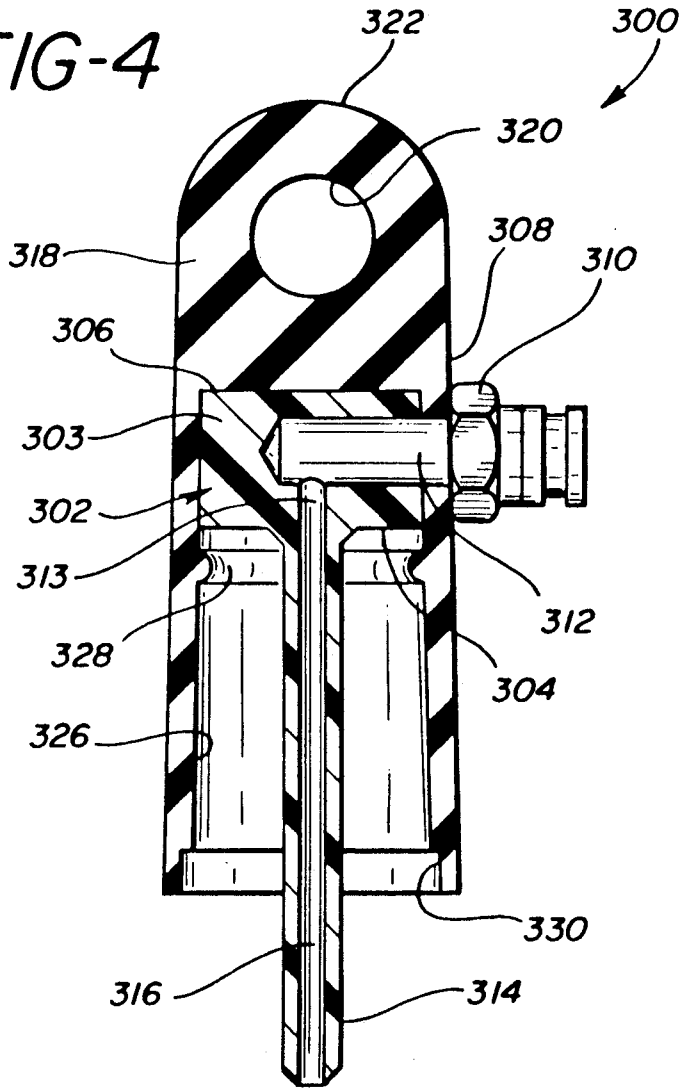
FIG. 4 is a front elevational view, in section, of the fitting of FIG. 3 taken along the line 4—4.
Figure 3:
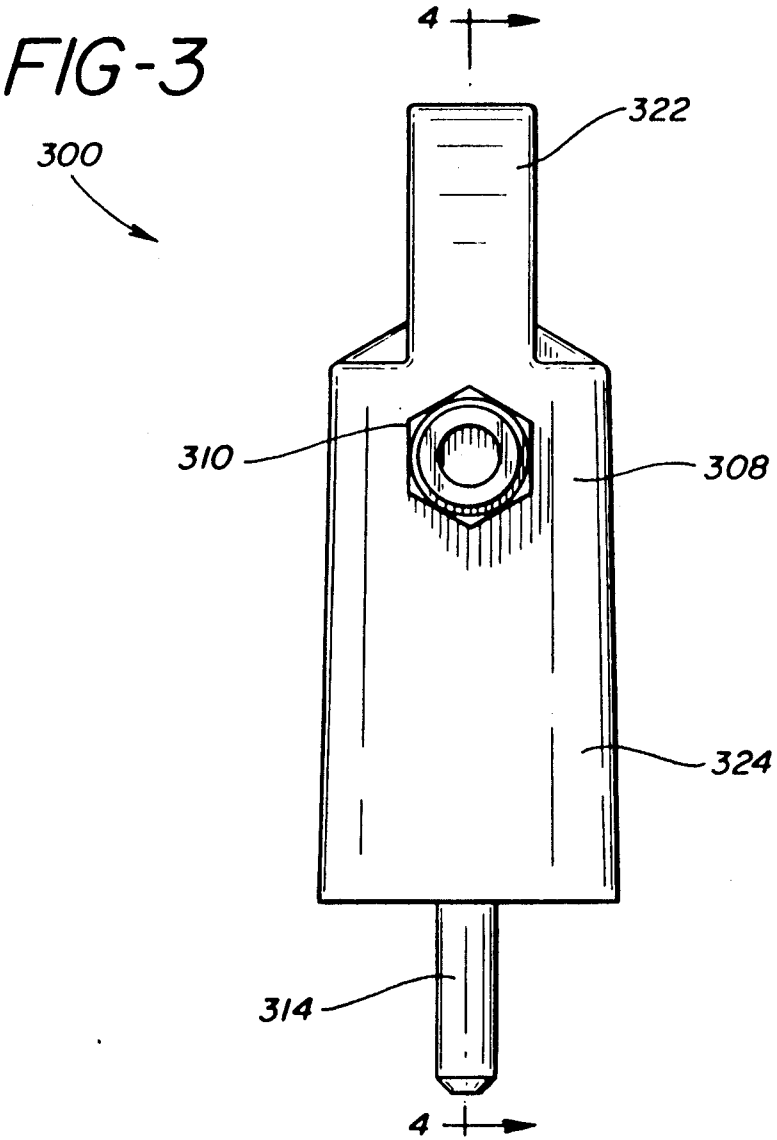
FIG. 3 is a side elevational view of a removable media injection fitting constructed in accordance with the concepts of the invention.

A suitable fitting 300 is shown in FIGS. 3 and 4. Fitting 300 has a central body portion 302 molded of an insulating elastomeric material with a core 303 having a first end 304 and a second end 306. Coupled to side wall 308 is male connector 310 of conventional design permitting suitable hoses (not shown) to be coupled thereto from a pump mechanism (not shown). Connector 310 has a tube 312 which extends inwardly from side wall 308 into central body portion 302 through core 303. A pin 314 which may be formed integrally with core 303, having a central bore 316 is coupled to tube 312 within central body portion 302 and core 303, and extends beyond first end 304 toward the open end of fitting 300. An upper body portion 318 also of insulating elastomeric material with an aperture 320 therein is coupled to central body portion 302 adjacent the second end 306 of central body portion 302 to act as a pulling eye 322. A hot stick, well known in the art but not shown, can be made to engage pulling eye 322 to install or remove fitting 300 from projection 230.

Extending from end 304 of central body portion 302 is a hollow skirt 324 also of insulating elastomeric material and formed as a part of central body portion 302 having an interior surface 326 in a frusto-conical shape to closely conform to the outer surface of projection 230 and is dimensioned to provide an interference fit with the outer surface of projection 230. An annular detent rib 328 is configured and positioned to engage annular recess 236 to hold in assembly fitting 300 and projection 230. This close conformity between the outer surface of projection 230 and interior surface 326 of fitting 300 as well as the filling of bore 240 with pin 314, both in an interference fit, preserves the electrical integrity of the cable component and cable while materials are inserted or withdrawn from the component and cables. A recess 330 in the interior surface 326 of skirt 324 adjacent the open free end thereof receives the shoulder of shield layer 206 of component 200 to provide a seal therewith.

Figure 5:
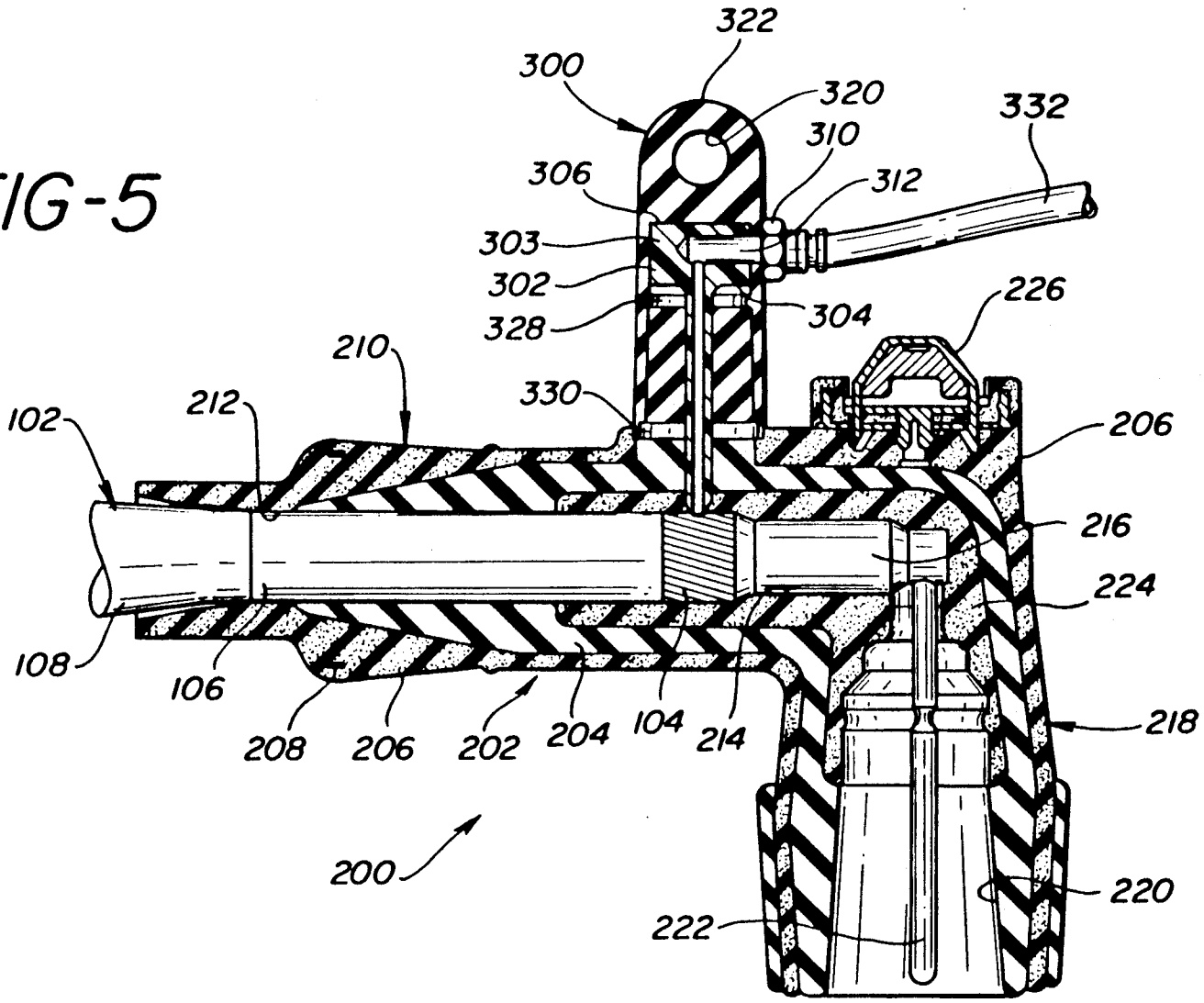
FIG. 5 is a side elevational view, in section, of the fitting of FIG. 4 installed upon the access of FIG. 2.

To use fitting 300, a hot stick is used to remove cap 250 from the position shown in FIG. 1 to expose projection 230 as shown in FIG. 2. The fitting 300 is then positioned upon projection 230 as shown in FIG. 5 such that pin 314 enters bore 240 dilating same to help hold the fitting 300 in place and annular detent rib 328 enters annular recess 236. Fitting 300 may be rotated in such position with rib 328 moving in recess 236 until coupling 310 is in position for attachment to a pump via a suitable hose 330. The fitting 300 may be rotated a full 360° about its longitudinal axis.

Once the injection or removal is complete the hose 330 will be removed and the fitting 300 removed by the use of a hot stick. Cap 250 will be replaced.

While there have been shown and described and pointed out the fundamental novel features of the invention as applied to the preferred embodiment, it will be understood that various omissions and substitutions and changes of the form and details of the device illustrated and in its operation may be made by those skilled in the art without departing from the spirit of the invention.

The embodiments in which an exclusive property or privilege is claimed are defined as follows:

1. A removable media injection fitting for use with a high voltage separable connector component having an access with a central bore therethrough to the interior of said component, comprising:

a body portion having a first end and a second end and at least one side surface, a passage within said body portion between said side surface and said first end;

a pin having a bore therethrough coupled to said passage adjacent said first end of said body portion for direct insertion into the bore of said access;

coupling means connected to said side surface for introducing or withdrawing a medium from said passage; and a skirt portion connected to said body portion adjacent said first end so proportioned and configured to be positionable upon the outer surface of said component access when said pin is inserted into the bore of said component access.

2. A fitting as defined in claim 1, wherein said body portion and said skirt portion are each fabricated of an insulating material.

3. A fitting as defined in claim 1, wherein said body portion and said skirt portion are each fabricated of an elastomeric insulating material.

4. A fitting as defined in claim 1, wherein said skirt portion has a first end adjacent said first end of said body portion, a second free end and an interior surface therebetween, and locking means on the interior surface of said skirt portion to lock said fitting on the outer surface of said component access.

5. A fitting as defined in claim 4, wherein said locking means is an annular rib proportioned to engage a corresponding recess on the outer surface of said component access.

6. A fitting as defined in claim 1, further comprising a pulling eye coupled to said second end of said body portion for the installation of said fitting upon said component access and the removal of said fitting.

7. A fitting as defined in claim 4, further comprising a recess in the interior surface of said skirt portion adjacent said second end of said skirt portion.

8. A fitting as defined in claim 1, wherein said pin is of a length sufficient to extend along the length of the entire access bore and into the interior of said component.

* * * * *

UNITED STATES PATENT AND TRADEMARK OFFICE

CERTIFICATE OF CORRECTION

PATENT NO. : 5,082,449

DATED : January 21, 1992

INVENTOR(S) : Borgstrom et al

It is certified that error appears in the above-identified patent and that said Letters Patent is hereby corrected as shown below:

On the cover page of the patent, column 1 under item 22 Filed: "Jul." should read --Aug.--

Column 3, line 14, "and are expelled contaminants" should read --and contaminants are expelled--

Signed and Sealed this

Twenty-first Day of December, 1993

Bruce Lehman

*Attest:*

BRUCE LEHMAN

*Attesting Officer*

*Commissioner of Patents and Trademarks*